US009008563B2

(12) United States Patent
Hirota

(10) Patent No.: US 9,008,563 B2
(45) Date of Patent: Apr. 14, 2015

(54) IMAGE FORMING APPARATUS

(75) Inventor: Kiyohito Hirota, Chiba (JP)

(73) Assignee: Seiko I Infotech Inc. (JP)

( * ) Notice: Subject to any disclaimer, the term of this patent is extended or adjusted under 35 U.S.C. 154(b) by 245 days.

(21) Appl. No.: 13/805,707

(22) PCT Filed: May 24, 2011

(86) PCT No.: PCT/JP2011/061802

§ 371 (c)(1),
(2), (4) Date: Mar. 7, 2013

(87) PCT Pub. No.: WO2011/162062

PCT Pub. Date: Dec. 29, 2011

(65) Prior Publication Data

US 2013/0170848 A1 Jul. 4, 2013

(30) Foreign Application Priority Data

Jun. 21, 2010 (JP) ..... 2010-140894
May 11, 2011 (JP) ..... 2011-106006

(51) Int. Cl.
*G03G 15/00* (2006.01)
*G03G 21/00* (2006.01)
(Continued)

(52) U.S. Cl.
CPC ..... *G03G 15/607* (2013.01); *B65H 19/12* (2013.01); *B65H 2220/02* (2013.01); *B65H 2403/411* (2013.01); *B65H 2511/12* (2013.01); *B65H 2511/514* (2013.01); *B65H 2553/51* (2013.01);
(Continued)

(58) Field of Classification Search
CPC ..... G03G 15/00; G03G 15/607; B65H 2403/411; B65H 2511/12; B65H 5/28; B65H 16/02; B65H 23/00; B65H 2301/12; B65H 2301/41368
USPC ..... 399/384; 271/9.1
See application file for complete search history.

(56) References Cited

U.S. PATENT DOCUMENTS 4,397,541 A * 8/1983 Lopata et al. ..... 399/384
5,014,073 A * 5/1991 Sone et al. ..... 347/198
(Continued)

FOREIGN PATENT DOCUMENTS

JP 63185730 8/1988

OTHER PUBLICATIONS

European Search Report mailed Dec. 10, 2013 issued in European Patent Appln. No. 11797949.2.

*Primary Examiner* — Nguyen Ha
(74) *Attorney, Agent, or Firm* — Adams & Wilks

(57) ABSTRACT

An image forming apparatus has rotatable members for rotatably retaining respective ones of flanges mounted to opposite ends of a roll sheet, and placement stages on which the roll sheet is to be placed and on which respective ones of the rotatable members are mounted. Racks are mounted to respective ones of the placement stages for undergoing movement to move the placement stages relative one another to vary a distance between the placement stages. A pinion is arranged between the racks for undergoing rotation to move the racks, and a potentiometer whose resistance value varies in accordance with a distance between the placement stages undergoing movement with rotation of the pinion is provided. An A/D converter outputs a value based on a resistance value of the potentiometer. A calculation device calculates a width of the roll sheet based on the value output from the A/D converter. A memory stores the calculated width of the roll sheet.

11 Claims, 7 Drawing Sheets

(51) Int. Cl.

| | |
|---|---|
| ***B65H 5/28*** | (2006.01) |
| ***B65H 23/00*** | (2006.01) |
| ***B65H 19/12*** | (2006.01) |
| ***B41J 11/00*** | (2006.01) |
| ***B41J 15/04*** | (2006.01) |
| ***B65H 16/02*** | (2006.01) |

(52) U.S. Cl.

CPC ..... *B41J 11/003* (2013.01); *B41J 15/04* (2013.01); *B65H 5/28* (2013.01); *B65H 16/02* (2013.01); *B65H 2301/12* (2013.01); *B65H 2301/41368* (2013.01); *B65H 2553/21* (2013.01)

(56) References Cited

U.S. PATENT DOCUMENTS

| | | | | |
|---|---|---|---|---|
| 5,238,198 | A * | 8/1993 | Jingu et al. | 242/532.7 |
| 5,267,704 | A * | 12/1993 | Kitamura et al. | 242/570 |
| 5,343,142 | A * | 8/1994 | Sasaki et al. | 324/71.1 |
| 5,689,759 | A | 11/1997 | Isemura et al. | 399/45 |
| 6,609,844 | B1 | 8/2003 | Petteruti et al. | 400/88 |
| 2003/0184007 | A1 | 10/2003 | Furukawa | 271/171 |
| 2005/0036811 | A1 * | 2/2005 | Matsuoka | 399/384 |
| 2009/0114758 | A1 * | 5/2009 | Yamada | 242/566 |
| 2009/0236385 | A1 * | 9/2009 | Itoh | 226/10 |

* cited by examiner

IMAGE FORMING APPARATUS

BACKGROUND OF THE INVENTION

1. Technical Field

The present invention relates to an image forming apparatus, and more particularly, to an image forming apparatus including a mechanism for detecting a width of a roll sheet which is received in the image forming apparatus.

2. Background Art

There is known an image forming apparatus for forming an image on a roll sheet selected from among roll sheets having various widths, which are received to be selectable in the image forming apparatus. In such an image forming apparatus, the width of the roll sheet to be used needs to be registered in advance in the image forming apparatus. A user of the image forming apparatus confirms the width of the roll sheet, and registers the confirmed width in the image forming apparatus. For example, when a roll sheet having a different width from that of the previously used roll sheet is received in the image forming apparatus, if the user forgets to register the width of the new roll sheet, there arises a problem in that an image is not output to the sheet of a desired size. Thus, there is a problem of printing trouble caused by forgetting the registration of the width of the roll sheet.

For example, as an image forming apparatus of Patent Literature 1, which includes a manual sheet feeding unit, there is disclosed a copying apparatus which automatically detects the sheet width by detecting a value of a voltage applied to a variable resistor in association with movement of restriction plates for guiding both side portions of the sheet, and calculating the sheet width based on the voltage value.

CITATION LIST

Patent Literature

[PTL 1] U.S. Pat. No. 5,689,759

In the above-mentioned conventional technology, the restriction plates are aligned at positions for guiding both side portions of separate sheets placed on the manual sheet feeding unit. Then, the voltage value output in accordance with the positions of the restriction plates is read. However, the conventional technology is for the case where separate sheets are placed on the manual sheet feeding unit, and cannot therefore be used for the roll sheet.

The restriction plates are necessary because the bundle of separate sheets may otherwise collapse, but in the case of the roll sheet, the sheet is rolled in advance into a roll shape and does not therefore collapse, and hence the restriction plates are not necessary. The restriction plates may be provided so as to guide a part of the sheet which is drawn from the roll, but such restriction plates are arranged in a sheet conveyance path, which leads to problems of, for example, increase in size of the apparatus and increase in conveyance load due to contact between the sheet and the restriction plates. Further, in the case of using the roll sheet, the roll needs to be rotated for drawing the sheet which is rolled into a roll shape to feed the sheet to an image forming unit and for rolling an unused part of the sheet again. Therefore, means for rotating the roll sheet is necessary, and when the sheet restriction plates are arranged on both sides of the roll sheet as in the conventional technology, the sheet restriction plates interrupt the operation of the means for rotating the roll sheet. Alternatively, the sheet restriction plates cannot restrict the roll sheet, which may result in inaccurate measurement. Further, the length of the roll sheet which is rolled into a roll shape varies. That is, the diameter of the roll varies, and hence, in the conventional technology, the restriction plates cannot accurately restrict the roll sheet depending on the positions of the restriction plates for the roll sheet. Such problems are inherent in the conventional technology.

The present invention has been made to solve the above-mentioned problems, and it is therefore an object thereof to reliably detect a width of a roll sheet and register the width of the roll sheet in an image forming apparatus.

SUMMARY OF INVENTION

The present invention provides the following configuration as a measure to achieve the above-mentioned object.

According to the present invention, there is provided an image forming apparatus, which receives a roll sheet and feeds the roll sheet to the image forming apparatus by conveyance means to record an image on the roll sheet, the image forming apparatus including: a pair of placement stages on which the roll sheet is to be placed; racks provided to the pair of placement stages, respectively; a pinion which is arranged between the racks, and operates in association with movement of the racks; a potentiometer which operates in association with rotation of the pinion; voltage detecting means for detecting a voltage value in accordance with a resistance value of the potentiometer; a roller which is held in contact with flanges fixed to both ends of the roll sheet, and rotates in association with rotation of the flanges; roller driving means for driving the roller; rotatable members arranged on the pair of placement stages, respectively, the rotatable members rotating in association with the rotation of the flanges and retaining the flanges together with the roller; and calculation means for calculating a width of the roll sheet based on the resistance value of the potentiometer which varies in accordance with a distance between the pair of placement stages which moves in association with each other by the racks and the pinion.

According to the present invention, it is possible to reliably detect the width of the roll sheet and register the detected width of the roll sheet in the image forming apparatus.

DETAILED DESCRIPTION OF THE INVENTION

Embodiments of the present invention are described below. In the embodiments of the present invention, an image forming apparatus is taken as an example.

Figure 5:
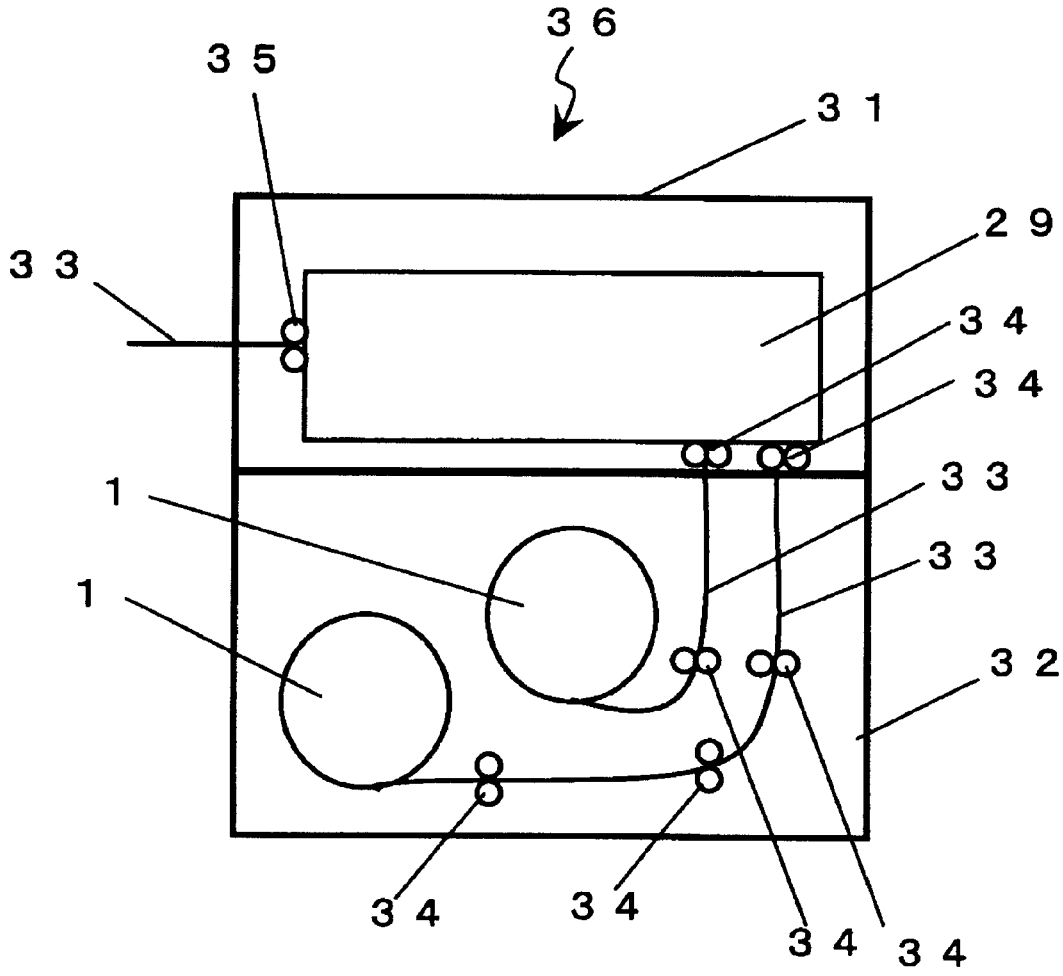
FIG. 5 is a schematic view illustrating the configuration of the image forming apparatus.

FIG. 5 is a schematic view illustrating a configuration of the image forming apparatus. An overview of a configuration of an image forming apparatus 36 is described. The image forming apparatus 36 includes an image forming unit 31 and a roll receiving unit 32. A roll sheet 33 is fed to the image forming unit 31 from one of a plurality of rolls 1 which are received in the roll receiving unit 32 and have different widths. The roll 1 is obtained by rolling a recording medium into a roll shape. Examples of the recording medium include a paper sheet and a thin flat plastic sheet. In this case, the roll 1 is obtained by rolling the roll sheet 33. The roll sheet 33 is guided to image forming means 29 of the image forming unit 31 by a plurality of conveyance rollers 34, and an image is recorded on the roll sheet 33 by the image forming means 29. The roll sheet 33 is delivered from the image forming means 29 by delivery rollers 35, and is discharged outside the image forming unit 31. The image forming means 29 selects a roll sheet 33 to be used in accordance with the size of the image.

Figure 1:
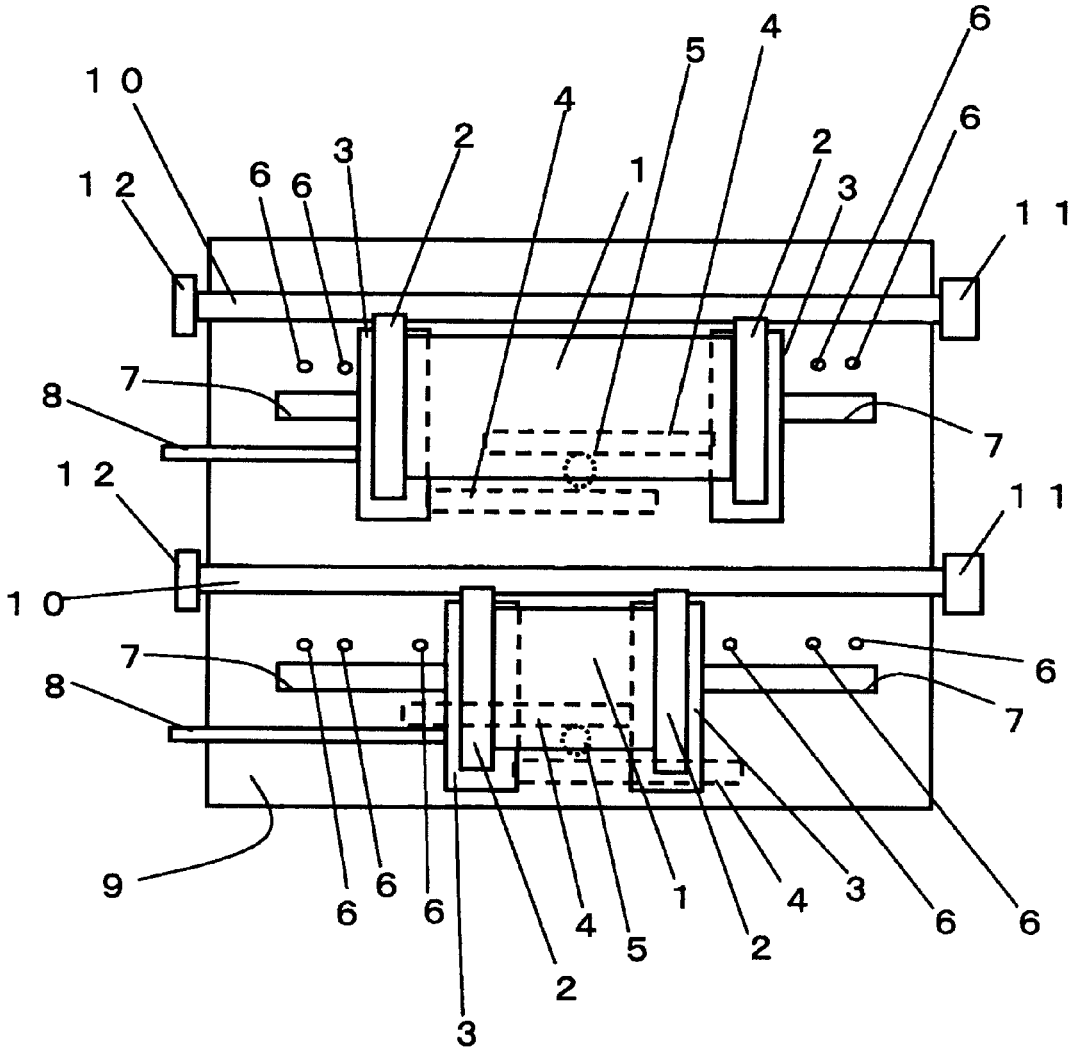
FIG. 1 is a schematic view illustrating a configuration of a roll sheet width detecting device.

FIG. 1 is a schematic view illustrating a configuration of a roll sheet width detecting device.

Flanges 2 are mounted to both ends of the roll 1. The roll 1 has various widths. However, the flanges 2 can be mounted to recording media having various widths. Two rolls 1 are received in the roll receiving unit 32. When the roll receiving unit 32 is upsized, the number of receivable rolls 1 is increased. Each roll 1 is placed on placement stages 3. The space of the roll receiving unit 32 is partitioned by a tray 9 into two upper and lower sections. The roll 1 is arranged in the upper section with respect to the tray 9. Racks 4 and a pinion 5 are arranged in the lower section partitioned by the tray 9. Two placement stages 3 are provided in pairs, and the racks 4 are respectively provided toward the opposing placement stages 3. The respective racks 4 are connected to the pinion 5. The tray 9 is provided with opening portions 7. The placement stages 3 are arranged over the upper and lower sides of the tray 9 through the respective opening portions 7 of the tray 9.

The flanges 2 abut against a drive roller 10. The drive roller 10 rotates in both directions by a drive motor 11. Through the rotation of the drive roller 10, the flanges 2 rotate as well. A rotary encoder 12 is provided at an end portion of the drive roller 10. When an output pulse from the encoder 12 is counted and calculated, a rotation direction, a rotation amount, and a rotation speed of the drive roller 10 are acquired.

The placement stages 3 move along a longitudinal direction of the roll 1. The opposing placement stages 3 move in association with each other by the racks 4 and the pinion 5. The placement stages 3 are moved in accordance with the width of the roll 1, and the flanges 2 mounted to both ends of the roll 1 are placed on the respective placement stages 3.

Positioning holes 6 are through holes provided in the tray 9 corresponding to the rolls 1 of the standard sizes. The positioning holes 6 can fix stop positions of the placement stages 3 corresponding to the rolls 1 of the standard sizes. The positioning holes 6 are long holes each having an elongated shape along the longitudinal direction of the roll 1. One of the placement stages 3 which move in pairs is provided with a lever for detecting presence and absence of the flanges 2. This lever is described later. A switch driving rod 8 is a shaft which rotates in association with the lever. The switch driving rod 8 passes through the placement stage 3, and is arranged in parallel to the movement direction of the placement stage 3. Therefore, the placement stage 3 slides along the switch driving rod 8, thereby achieving steady movement.

Figure 2:
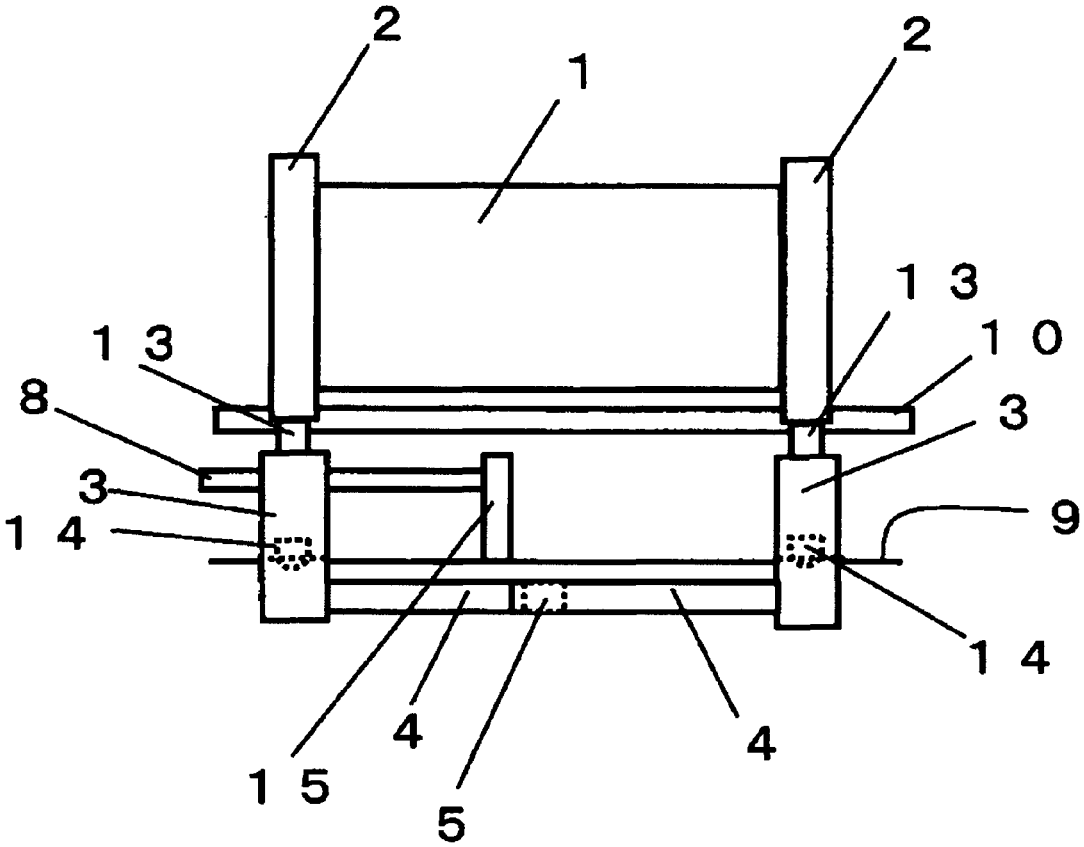
FIG. 2 is a schematic side view illustrating the configuration of the roll sheet width detecting device.

FIG. 2 is a schematic side view illustrating the configuration of the roll sheet width detecting device.

Rotatable members 13 are rotatably provided on the respective placement stages 3. The flanges 2 are placed on the drive roller 10 and the respective rotatable members 13. When the recording medium is drawn from the roll 1, the flanges 2 rotate in association with this operation. The drive roller 10 and the rotatable members 13 rotate in association with the rotation of the flanges 2.

The placement stages 3 are respectively provided with pins 14 which are biased downward. When the placement stages 3 are moved, the pins 14 slide on the tray 9. At the positions of the positioning holes 6, the pins 14 are fitted into the respective positioning holes 6 due to the biasing. A retainer 15 is a plate for rotatably retaining the switch driving rod 8. The placement stages 3 are not movable to the inner side with respect to the retainer.

Figure 3:
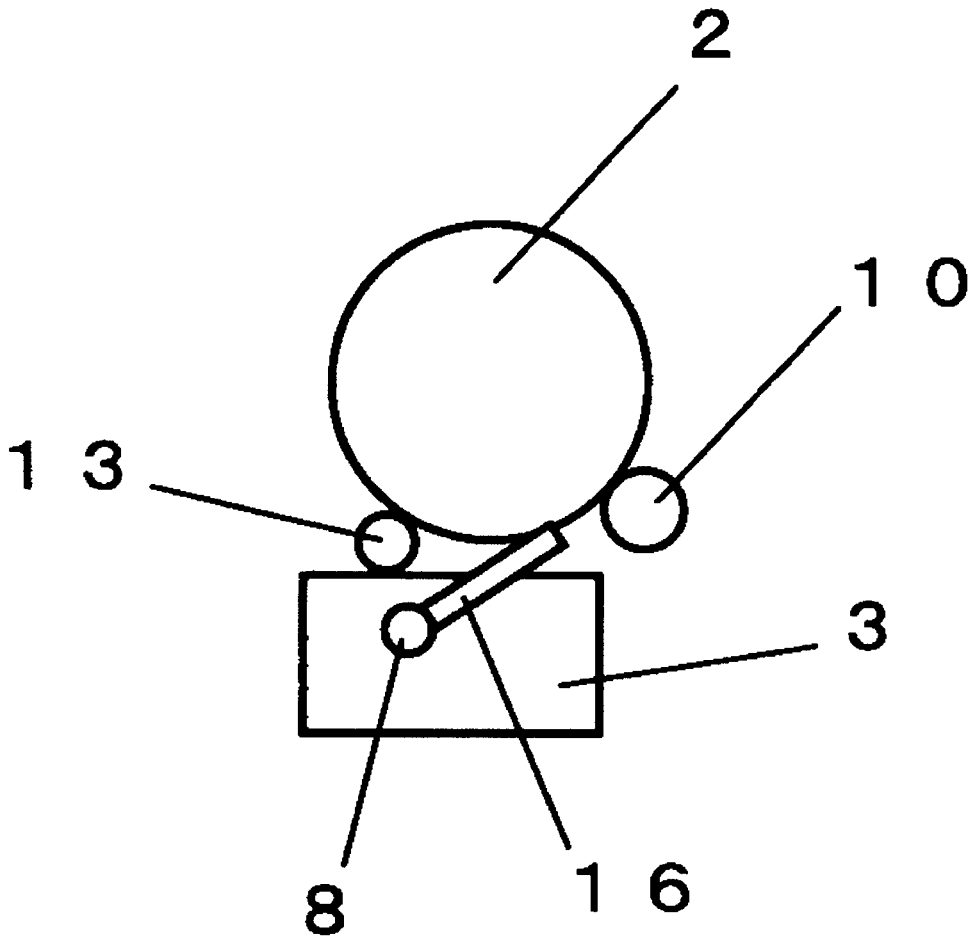
FIG. 3 is a schematic view illustrating a configuration of a roll sheet presence/absence detecting unit.

FIG. 3 is a schematic view illustrating a configuration of a roll sheet presence/absence detecting unit.

A lever 16 is arranged to be rotatable about the switch driving rod 8. Further, the lever 16 is biased toward the flange 2.

When the flange 2 is located on the lever 16, the lever 16 is pressed by the flange 2 and the switch driving rod 8 rotates in association with this operation. Means for detecting rotation is provided at an end portion of the switch driving rod 8. The means for detecting rotation is described later.

When the flange 2 is not located on the lever 16, the lever 16 moves in the biasing direction and the switch driving rod 8 rotates in association with this operation. The means for detecting rotation is provided at the end portion of the switch driving rod 8, and detects the state of the lever 16. The means for detecting rotation is described later.

Figure 4:
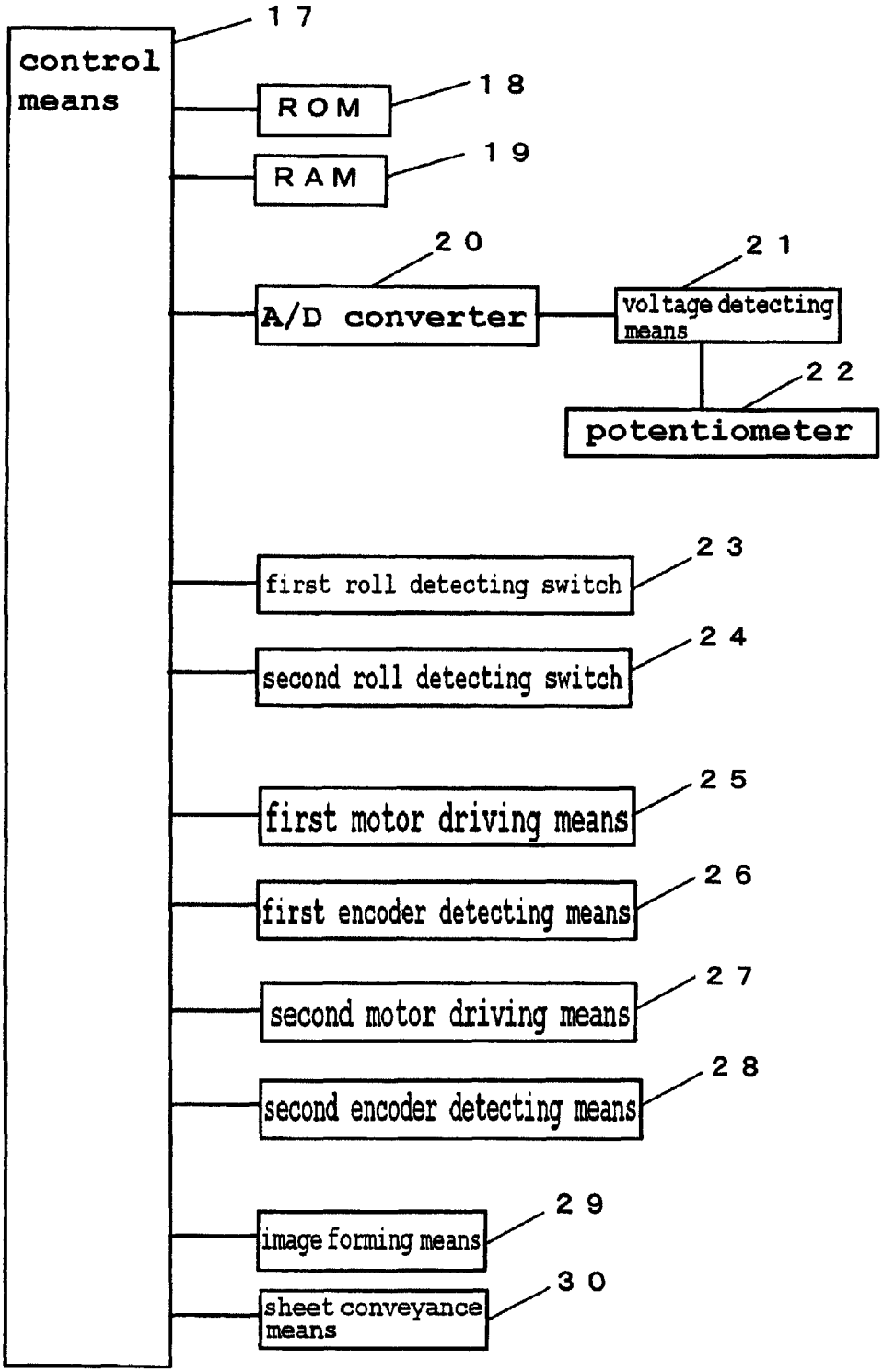
FIG. 4 is a schematic block diagram illustrating a configuration of an image forming apparatus.

FIG. 4 is a schematic block diagram illustrating the configuration of the image forming apparatus.

Control means 17 controls the entire image forming apparatus. For example, the control means 17 is a CPU. A ROM 18 is storage means for storing data and an operation program of the control means 17. A RAM 19 is a memory for data reading and writing to be performed in accordance with the operation of the control means 17.

A potentiometer 22 is connected to the pinion 5, and the potentiometer 22 rotates in association with the rotation of the pinion 5. The potentiometer 22 is variable in value of a built-in resistor along with its rotation. A resistor is connected in series to the resistor of the pinion potentiometer 22. A constant voltage is applied to the connected resistors. Voltage detecting means 21 detects a voltage applied to both ends of the resistor of the potentiometer 22. An A/D converter 20 performs A/D conversion for an output value of the voltage detecting means 21. Voltage value data obtained through the conversion by the A/D converter 20 is output to the control means 17. Voltage value data corresponding to the positions of the placement stages 3 is prestored in the ROM 18, and based on the voltage value data, the positions of the placement stages 3 can be acquired.

A first roll detecting switch 23 is a switch for detecting presence and absence of one of the two rolls 1 received in the roll receiving unit 32. The first roll detecting switch 23 is connected to the switch driving rod 8 which rotates in association with the lever 16 of the placement stage 3, and the switch is turned ON and OFF in accordance with the state of the lever 16. The first roll detecting switch 23 is connected to the control means 17, and the control means 17 acquires the ON/OFF state of the switch in association with the presence and absence of the roll 1.

A second roll detecting switch 24 is a switch for detecting presence and absence of another of the two rolls 1 received in the roll receiving unit 32. The second roll detecting switch 24 is connected to the switch driving rod 8 which rotates in association with the lever 16 of the placement stage 3, and the switch is turned ON and OFF in accordance with the state of the lever 16. The second roll detecting switch 24 is connected to the control means 17, and the control means 17 acquires the ON/OFF state of the switch in association with the presence and absence of the roll 1.

First motor driving means 25 is connected to the drive motor 11 for driving the drive roller 10 which rotates one of the two rolls 1 received in the roll receiving unit 32. The first motor driving means 25 is controlled by the control means 17 to drive and control this drive motor 11.

Second motor driving means 27 is connected to the drive motor 11 for driving the drive roller 10 which rotates another of the two rolls 1 received in the roll receiving unit 32. The second motor driving means 27 is controlled by the control means 17 to drive and control this drive motor 11.

First encoder detecting means 26 detects a signal from the encoder 12 connected to the drive roller 10 which rotates one of the two rolls 1 received in the roll receiving unit 32. The first encoder detecting means 26 is connected to the control means 17 to output a signal to the control means 17. Based on this signal, the control means 17 calculates and acquires the rotation direction, the rotation speed, and the rotation amount of the drive roller 10.

Second encoder detecting means 28 detects a signal from the encoder 12 connected to the drive roller 10 which rotates another of the two rolls 1 received in the roll receiving unit 32. The second encoder detecting means 28 is connected to the control means 17 to output a signal to the control means 17. Based on this signal, the control means 17 calculates and acquires the rotation direction, the rotation speed, and the rotation amount of the drive roller 10.

The image forming means 29 forms an image on the recording medium. For example, the image forming means 29 is laser or LED electrophotographic image forming means.

Sheet conveyance means 30 feeds and delivers the roll sheet 33 to the image forming means 29 from the roll 1 received in the roll receiving unit 32.

The operation of the image forming apparatus 36 is described.

The roll receiving unit 32 is capable of receiving two rolls 1. In accordance with the sheet receiving positions, data on the widths of the received rolls 1 is stored in the RAM 19. In accordance with the widths of the rolls 1, the positions of the placement stages 3 are shifted. The flanges 2 are mounted to both ends of each roll 1, and hence the placement stages 3 are moved to the positions at which the flanges 2 are placed on the respective rotatable members 13. The flanges 2 mounted to the roll 1 are placed on the respective rotatable members 13 and the drive roller 10. The roll 1 becomes rotatable by the rotatable members 13 and the drive roller 10.

The racks 4 rotate the pinion 5 in accordance with the positions of the respective placement stages 3. The resistance value of the potentiometer 22 varies in association with the rotation of the pinion 5. The control means 17 acquires the voltage value of the voltage detecting means 21 in accordance with the positions of the placement stages 3, and acquires positional information of the placement stages 3 in accordance with the voltage value. Based on the positional information of the placement stages 3, the control means 17 acquires a value of the width of the roll 1, and stores the value of the width of the roll 1 in the RAM 19 corresponding to the receiving position of the roll 1. For another roll 1, the control means 17 can similarly store a value of the width of the roll 1 in the RAM 19 corresponding to the receiving position of the roll 1.

The widths of the rolls 1 received in the roll receiving unit 32 are acquired, and hence the rolls 1 having different sizes can be selected for use in accordance with the size of the image.

It is preferred that the detection of the width of the roll 1 be executed when the detection result from the first roll detecting switch 23 or the second roll detecting switch 24 is monitored and the state has changed from a state in which the flanges 2 are not placed to a state in which the flanges 2 are placed. Further, the width of the roll 1 may be detected in response to a request from the outside.

The rotatable members 13 are arranged on the placement stages 3, and the flanges 2 are placed to be rotatable by the respective rotatable members 13 and the drive roller 10. Accordingly, there is no need to provide any redundant component in the conveyance path of the recording medium, which can lead to a compact configuration.

Further, in the case of using the rolls 1 of the standard sizes, the positioning holes 6 serve as references therefor so that the placement stages 3 can easily be moved to the intended positions. Further, the positioning holes 6 each have an oblong shape, and hence, even when a positional error has occurred at the time of the movement of the placement stages 3 which operate in association with each other, the pins 14 are fitted into the respective positioning holes 6.

Through the detection of the rotation speed of the drive roller 10, the remaining length of the sheet of the roll 1 can be estimated. That is, the speed of drawing the roll sheet 33 from the roll 1 is constant, and hence, when the remaining length of the sheet of the roll 1 is large, the rotation speed of the drive roller 10 is low, and when the remaining length of the roll 1 is large, the rotation speed of the drive roller 10 is high. A correspondence between the rotation speed and the remaining length of the roll 1 is prestored in the ROM 18 as setting data, and the control means 17 compares the setting data with a rotation speed in a given case and performs calculation of estimating the remaining length. Further, when there is no remaining length of the roll 1, the drive roller 10 does not rotate, and hence a zero state of the remaining length can be detected.

Figure 6:
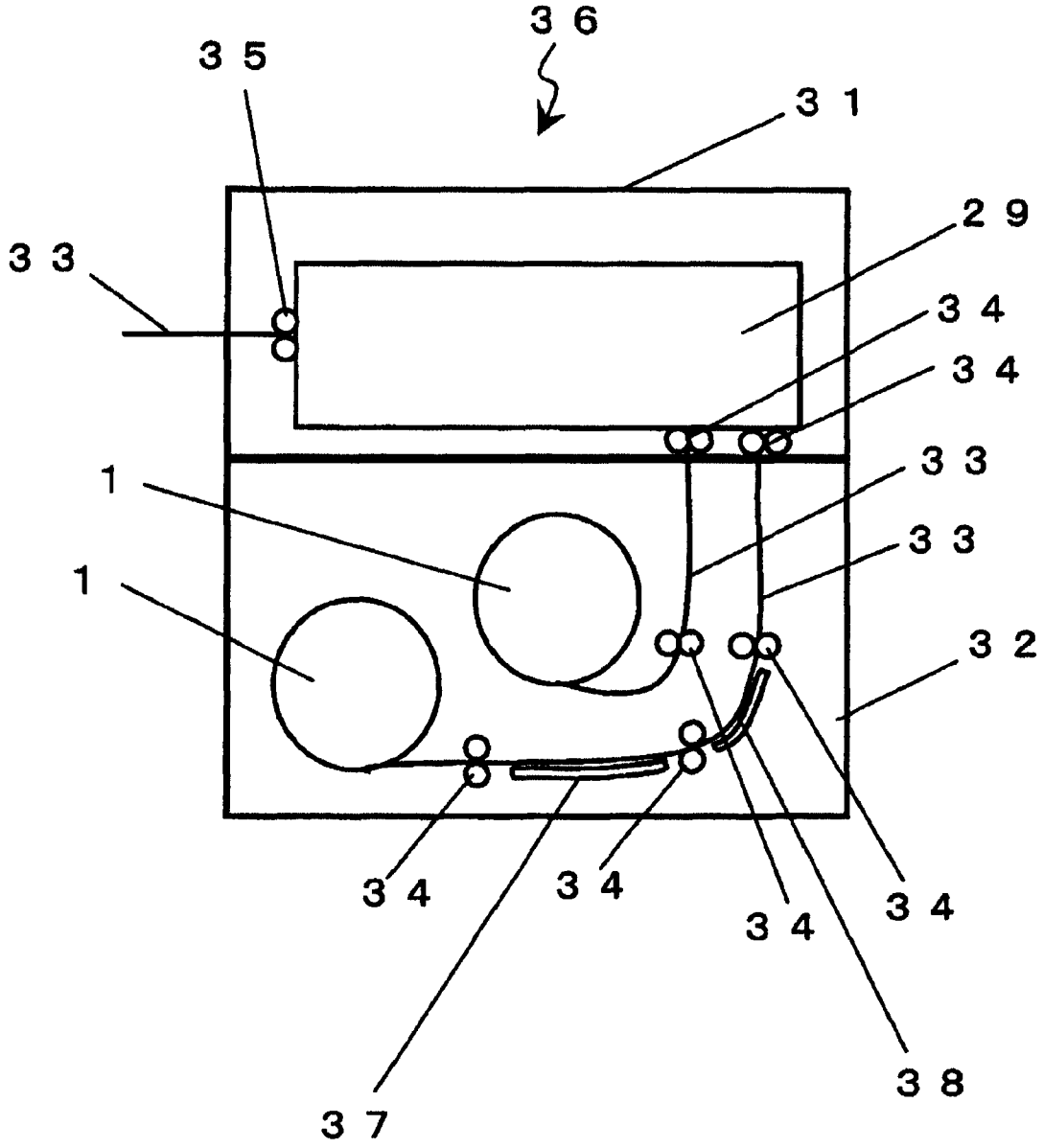
FIG. 6 is a schematic view illustrating another configuration of the image forming apparatus.

FIG. 6 is a schematic view illustrating another configuration of the image forming apparatus. When the recording medium which is being conveyed is attracted onto the conveyance path due to static electricity or the like, the recording medium may meander and cause a jam, and this causes vibration in the flanges 2 and the placement stages 3, which may result in erroneous detection in the potentiometer 22. It is preferred to prevent such abnormal conveyance. Therefore, guide units 37 and 38 are arranged in the conveyance path between the conveyance rollers 34 so that the recording medium moves smoothly. The guide units 37 and 38 have a flat shape or a curved shape conforming to the shape of the conveyance path.

Figure 7:
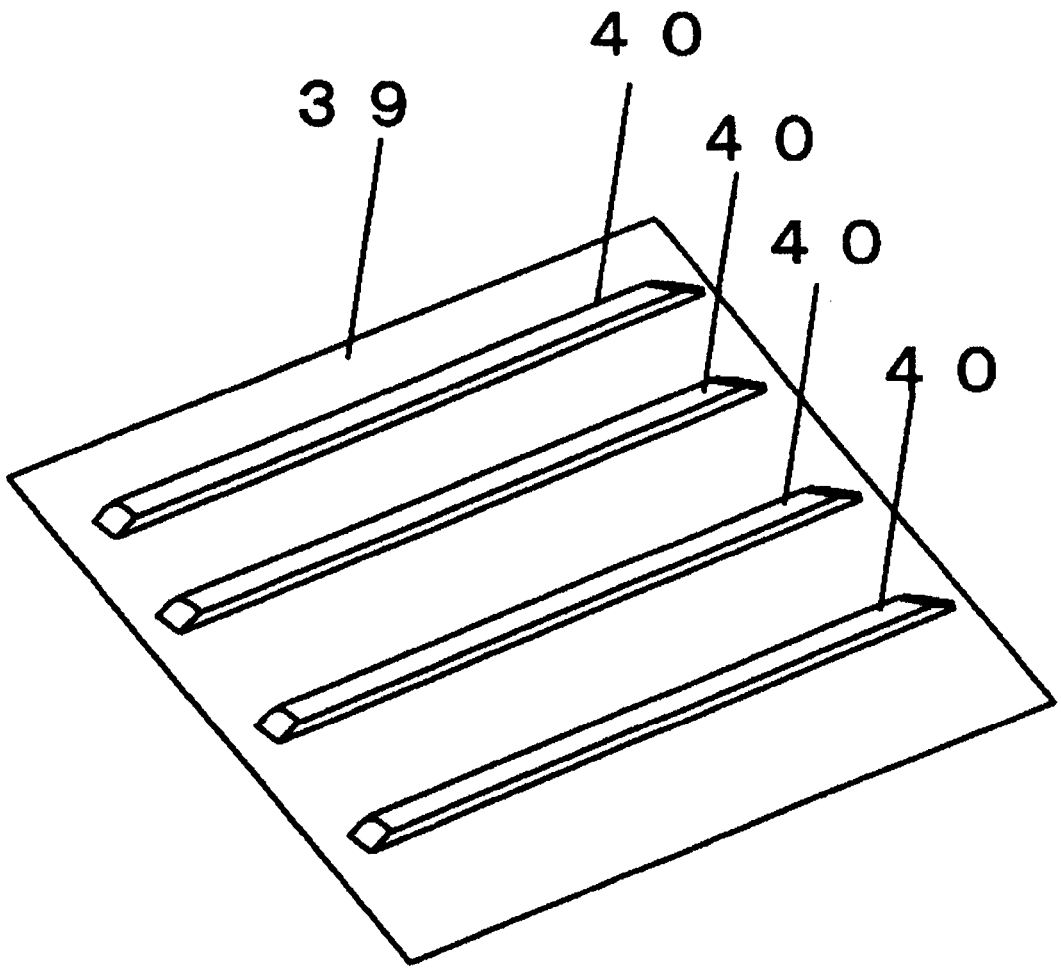
FIG. 7 is an explanatory view illustrating a unit for reducing resistance at the time of conveying a roll sheet.

FIG. 7 is an explanatory view illustrating a guide unit for smoothing the conveyance of the roll sheet. Projecting portions 40 are formed on a plate 39 to be arranged along the conveyance direction of the recording medium. A plurality of projecting portions 40 equal in height are formed in parallel to one another. When the guide unit is made of plastics, the plate 39 and the projecting portions 40 may be molded integrally to each other. When the guide unit is made of a metal, the projecting portions 40 may be formed by pressing the plate 39. Further, the projecting portions 40 may be provided by bonding stick-like plastics to the plate 39. The top portions of the projecting portions 40 are brought into contact with the recording medium, and the recording medium can smoothly move along the longitudinal direction of the projecting portions 40 with the reduced resistance at the time of conveyance.

The guide units 37 and 38 are arranged so that the projecting portions 40 are located in parallel to one another in the conveyance direction of the recording medium. A plurality of plates 39 are arranged along the conveyance path in the conveyance direction, and a plurality of plates 39 may also be arranged in a direction orthogonal to the conveyance direction. A plurality of small plates 39 are arranged and used at positions at which the recording medium does not move smoothly.

As described above, the guide units 37 and 38 are provided, and hence the recording medium moves smoothly so that the meandering and the jam can be prevented. Therefore, the flanges 2 and the placement stages 3 do not vibrate and erroneous operation can thus be prevented.

As described above, the width of the roll sheet can be acquired by measuring the distance between the flanges 2 arranged at both ends of the roll 1. Further, the flanges 2 are free from the vibration and the meandering, and hence accurate measurement can be performed. However, when the flanges 2 are not firmly inserted to a sheet core in a perpendicular direction, the flanges 2 are not perpendicularly placed on the placement stages 3, which may cause conveyance failure of the roll sheet. As another embodiment for such a case, the placement stages 3 on which the flanges 2 are placed are not arranged only directly under the flanges 2, but are each structured to support an outer peripheral portion of the flange 2. With this structure, the flanges 2 can be maintained in parallel to the vertical direction. For example, the placement stages 3 are each structured to support two points on the outer peripheral portion of the flange 2 at the height of the center axis so that the flange 2 does not move in the axial direction.

INDUSTRIAL APPLICABILITY

The present invention is applicable to an apparatus which receives media each rolled into a roll shape, and draws the media to record an image thereon.

REFERENCE SIGNS LIST

1 roll
2 flange
3 placement stage
4 rack
5 pinion
6 positioning hole
7 opening portion
8 switch driving rod
9 tray
10 drive roller
11 drive motor
12 encoder
13 rotatable member
14 pin
15 retainer
16 lever
31 image forming unit
32 roll receiving unit
33 roll sheet
34 conveyance roller
35 delivery roller
36 image forming apparatus

The invention claimed is:

1. An image forming apparatus configured to receive and convey a roll sheet to an image forming unit to record an image on the roll sheet, the image forming apparatus comprising:

a pair of rotatable members for rotatably retaining flanges fixedly mounted to respective ones of opposite ends of the roll sheet;

a roller for rotatably retaining the flanges together with the rotatably members;

a pair of placement stages on which respective ones of the rotatable members are mounted and on which the roll sheet is to be placed, the placement stages being mounted for undergoing movement along a longitudinal direction of the roll sheet;

a pair of racks mounted to respective ones of the pair of placement stages for undergoing movement to move the pair of placement stages relative to one another to vary a distance between the pair of placement stages;

a pinion arranged between the pair of racks for undergoing rotation to move the pair of racks;

a potentiometer whose resistance value varies in accordance with a distance between the pair of placement stages undergoing movement with rotation of the pinion;

voltage detecting means for detecting a voltage value in accordance with a resistance value of the potentiometer;

calculation means for calculating a width of the roll sheet based on the detected voltage value a lever arranged between the roller and the rotatable member of at least one of the pair of placement stages for undergoing movement in accordance with presence and absence of the flanges;

a shaft extending through at least one of the placement stages and being mounted to undergo rotational movement in accordance with movement of the lever;

a switch arranged at an end portion of the shaft; and roll sheet detecting means for detecting the presence and absence of the flanges in accordance with an output from the switch.

2. An image forming apparatus according to claim 1, wherein the at least one of the pair of placement stages moves in contact with the shaft.

3. An image forming apparatus according to claim 1, further comprising:

an encoder arranged at one end portion of the roller; and roller rotation detecting means for detecting a rotation direction, a rotation speed, and a rotation amount of the roller in accordance with an output from the encoder.

4. An image forming apparatus according to claim 1, wherein the pair of placement stages comprises a plurality of pairs of placement stages; and wherein the image forming apparatus further comprises storage means for storing the width of the roll sheet, which is calculated by the calculation means, in accordance with positions of each of the plurality of pairs of placement stages on which the roll sheet is to be received.

5. An image forming apparatus according to claim 1, further comprising at least one guide unit arranged along a conveyance path of the roll sheet, the at least one guide unit having a plurality of projecting portions arranged in parallel to each other in a conveyance direction of the roll sheet, the plurality of projecting portions having top portions brought into contact with a surface of the roll sheet.

6. An image forming apparatus according to claim 5, wherein the at least one guide unit comprises a plurality of guide units arranged at least in the conveyance direction of the conveyance path.

7. An image forming apparatus comprising:

a pair of rotatable members for rotatably retaining respective ones of flanges mounted to opposite ends of a roll sheet;

a pair of placement stages on which the roll sheet is to be placed and on which respective ones of the rotatable members are mounted;

a pair of racks mounted to respective ones of the pair of placement stages for undergoing movement to move the pair of placement stages relative to one another to vary a distance between the pair of placement stages;

a pinion arranged between the pair of racks for undergoing rotation to move the pair of racks;

a potentiometer whose resistance value varies in accordance with a distance between the pair of placement stages undergoing movement with rotation of the pinion;

an A/D converter for outputting a value based on a resistance value of the potentiometer;

calculation means for calculating a width of the roll sheet based on the value output from the A/D converter;

a memory for storing the calculated width of the roll sheets;

a roller for rotatably retaining the flanges together with the rotatable members;

a lever arranged between the roller and the rotatable member of at least one of the pair of placement stages for undergoing movement in accordance with presence and absence of the flanges;

a shaft extending through at least one of the pair of placement stages and being mounted to undergo rotational movement in accordance with movement of the lever;

a switch arranged at an end portion of the shaft; and roll sheet detecting means for detecting the presence and absence of the flanges in accordance with an output from the switch.

8. An image forming apparatus according to claim 7, further comprising a roller for rotatably retaining the flanges together with the rotatable members; an encoder arranged at one end portion of the roller; and roller rotation detecting means for detecting a rotation direction, a rotation speed, and a rotation amount of the roller in accordance with an output from the encoder.

9. An image forming apparatus according to claim 7, wherein the pair of placement stages comprises a plurality of pairs of placement stages on which respective ones of roller sheets are to be placed; and wherein the memory stores the calculated width of the roll sheet in accordance with positions of each of the pairs of placement stages.

10. An image forming apparatus according to claim 7, further comprising at least one guide unit arranged along a conveyance path of the roll sheet, the at least one guide unit having a plurality of projecting portions arranged in parallel to each other in a conveyance direction of the roll sheet, the plurality of projecting portions having top portions brought into contact with a surface of the roll sheet.

11. An image forming apparatus according to claim 10, wherein the at least one guide unit comprises a plurality of guide units arranged at least in the conveyance direction of the conveyance path.

* * * * *